United States Patent [19]

Hirmann

[11] 3,998,130

[45] Dec. 21, 1976

[54] PRESSURE DRIVEN MOTOR

[75] Inventor: Georg Hirmann, Zurich, Switzerland

[73] Assignee: Inventa AG fur Forschung und Patentverwertung, Zurich, Zurich, Switzerland

[22] Filed: May 15, 1975

[21] Appl. No.: 577,865

[30] Foreign Application Priority Data

May 21, 1974 Switzerland ..... 6958/74

[52] U.S. Cl. ..... 91/59; 417/295; 91/180; 91/504

[51] Int. Cl.[2] ..... F01B 13/04; F01C 21/12

[58] Field of Search ..... 91/472, 499–507, 91/59; 417/295, 476; 418/45; 251/7

[56] References Cited

UNITED STATES PATENTS

| | | | |
|---|---|---|---|
| 1,087,160 | 2/1914 | Eizermann | 91/507 |
| 2,346,236 | 4/1944 | Rose et al. | 418/45 |
| 2,897,767 | 8/1959 | Cordis | 417/476 |
| 3,014,348 | 12/1961 | Mauch | 91/472 |
| 3,050,004 | 8/1962 | Heintzmann | 417/295 |
| 3,431,573 | 3/1969 | Frandsen | 251/7 |

*Primary Examiner*—William L. Freeh
*Attorney, Agent, or Firm*—Bierman & Bierman

[57] ABSTRACT

Fluid motor means having a sectional housing containing a fluid flow passage therebetween is provided. The passage has a cross section which varies in response to load changes, along with means in the passage for varying the flow of pressure fluid to the motor in response to said load changes. Expansion or fluid chambers are preferably used to couple input and output members in a manner responsive to torque changes.

8 Claims, 2 Drawing Figures

PRESSURE DRIVEN MOTOR

Fluid motors, i.e., for example, pneumatic and hydraulic motors with an unchangeable working volume, have the property of varying their speed in dependence upon load with a constant supply of pressure medium. At higher speed, the amount of pressure medium is smaller per working chamber than at low speed, which results in a lower torque. The product of speed and amount or charge per working chamber is approximately constant. This gives rise to the torque and power characteristics which are so well known in compressed air motors. These characteristics are low speed, high torque; and high speed, low torque; with power maximum at half the no-load speed.

Motors of this type are not suitable for applications in which motors speeds independent of load are wanted. In the past, the devices for regulating speed independent of load have been complicated and costly, these devices measuring the speed of the motor and regulating through feedback the amount of fluid medium supplied.

In accordance with the present invention, the fluid motor is driven by means of a pressure medium, wherein a load torque dependent element actuated directly by the motor is used to control the amount of pressure medium supplied. It has been found that control response, with the present invention, is substantially instantaneous.

The preferred embodiments of the subject matter of the invention will be described with reference to the accompanying drawings, in which like numerals refer to like parts and wherein.

Figure 1:
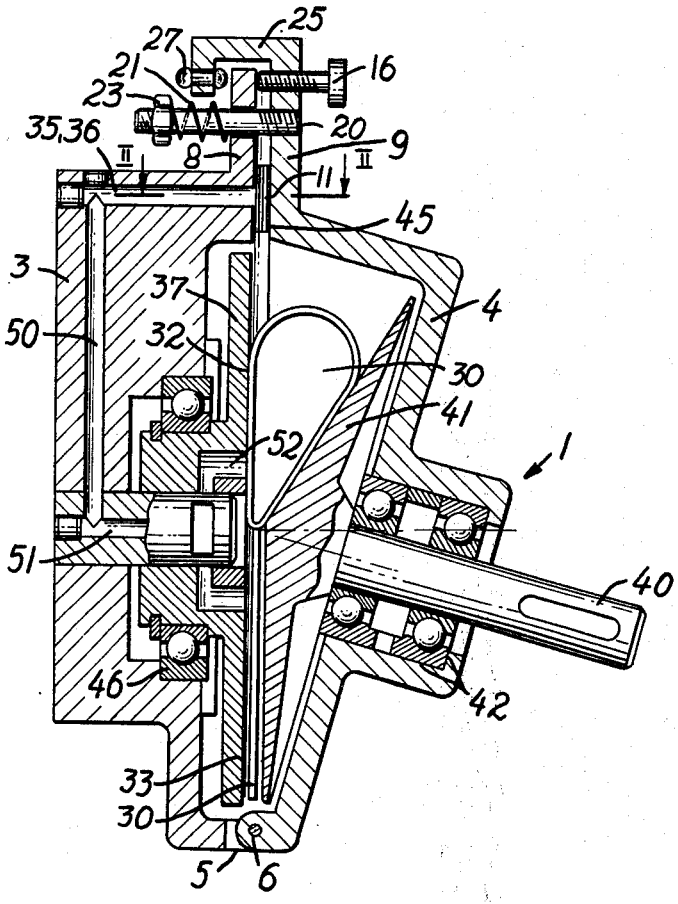
FIG. 1 is a longitudinal section through a fluid motor having expansion chambers disposed between two rotating supporting discs inclined with respect to one another.

The motor shown in FIG. 1 has two housing sections 3 and 4 which are interconnected such as by means of a hinge 5 and hinge pin 6 so that they can be swung open. Each of these sections has a flange 8 and 9, respectively, these flanges forming part of the respective housing sections. The housing flange 8 is of plane form, while the housing flange 9 is provided with a ridge 11 for the purpose of controlling the flow cross-section of a flexible pressure medium conduit 14 (see FIG. 2) arranged between the two flanges 8 and 9.

The flange 9 is provided with an idling adjustment screw 16. For the purpose of holding the two housing sections 3, 4 together, flanges 8 and 9 also carry a fastening pin 20 provided with a compression spring 21 which serves to resiliently connect the upper portion of the housing sections. A pretensioning nut 23 enables a suitable bias to be adjusted between the two housing flanges 8 and 9.

The flange 9 is equipped with a yoke 25. The yoke 25 enables the maximum spreading of the two housing halves 3 and 4 to be fixed by means of a full-load limiting screw 27. The position of the screw 27 determines the maximum flow cross-section of the conduit 14 by regulating the maximum separation, during operation of the motor, between housing flanges 8 and 9.

Arranged in the interior of the housing are at least three inflatable bags or fluid cells 30 made of a deformable material, in particular an expandable film or a sheet type material. The material selected should be sufficiently rigid to permit expansion of the cell from the empty to the full condition, as shown in FIG. 1, without rupturing or permanently stretching the cell. Two of said bags are visible in FIG. 1. The fluid cells 30 are fastened by means of adhesive coatings 32 and 33 to a rotating cylindrical support disc 37. The fluid cells 30 are adapted to be operatively connected, such as by friction, to a second rotating cone 41 having an output shaft 40.

Figure 2:
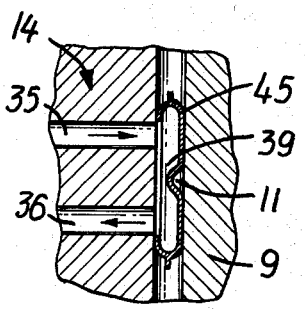
FIG. 2 is a section through a part of the fluid motor taken on the line II — II in FIG. 1.

As can be seen in section in FIG. 2, the housing section 3 is provided with pressure medium input and output ducts 35, 36 in the region of flange 8, these ducts being located one behind the other in FIG. 1. In the region of these two ducts 35 and 36, the flexible pressure medium conduit 14 is in the form of a throttling fluid cell 45 in the sense that the ridge 11 is intended to vary the cross-section 39 between the two ducts 35 and 36 in accordance with the position of the associated flange 9. The throttling cell 45, which is preferably made of deformable plastic, foil or film, may, for example, be attached to the housing section 3 by adhesive or cement.

Two bearings 42 and 46 for the rotating shaft 40 and the supporting disc 37 are shown in FIG. 1 In order to put the motor into operation, pressure medium, for instance compressed air, is supplied through the feed duct 35. The pressure medium moves through the passage bridging ducts 35 and 36 and via ducts 50, 51 and 52 inflates the fluid cells 30. In this way, in consequence of the described arrangement of the two supporting discs 37 and 41, there results a torque on the supporting cone 41 which is proportional to the pressure of the fluid cells 30 against the cone. As a consequence, the cone and fluid cells rotate together with the supporting disc 37.

With increasing power requirements, i.e. with falling speed and, therfore, — on better filling of the fluid cells 30 — with increasing torque, the wedge forces which try to open the two sections 3 and 4 of the housing about the hinge pin 6 by means of the fluid cells also become greater. Consequently, with increasing torque and increasing spreading force, the ridge 11 of the flange 9 will move away from the opposite flange 8 against the preset force of spring and enlarge the supply cross section 39 accordingly. During this process, the spring 21 is compressed and a substantially instantaneous state of equilibrium is obtained. In this way, the opening between the two sections 3 and 4 of the housing varies with the load condition at the shaft 40 and, the flow cross-section 39 regulated by the ridge 11 will also vary accordingly. Accordingly, control of the supply of pressure medium is effected by the cross section available to flow in the throttling cell 14 which varies dependence upon the load torque. By appropriate choice of the width of the throttling cell 45 and of the characteristic of the spring 21, it is possible, with increasing load at the shaft 40, to cause its speed to decrease, to maintain it or to override it, i.e. increase it.

It is therefore possible to achieve an increase in speed in accordance with the present invention; for example, in the case of an increasing external load, at which motors known heretofore show a reduction in speed or, at the most, with great expenditure for control elements, a constant speed. Due to the small control travel or distance, the inertia forces that occur are very small. Control is effected directly in the present invention with the active forces, so that the automatic control system is essentially within the motor itself. In this motor, a variation in torque is used directly for controlling the supply of driving energy, preferably by means of a fluid throttling call integrated in the motor.

In addition to substantial savings in manufacture, the arrangements shown render possible a compact design, generally more favorable flow (consumption) direct (pre-setting) of the maximal speed and even automatic changeover from low-speed idling to any desired on-load speed.

The pressure-medium driven motor according to the present invention, wherein a load torque dependent element actuated directly by the motor controls the amount of pressure medium supplied, can be characterized as follows:

The motor according to the present invention advantageously has as driving elements at least three fluid cells which are advantageously inflatable and squeezable. Such cells are made of materials which are flexible, i.e. which offer only little resistance to bending, which have a very low elastic modulus and which show a very good thermal conductivity. For practical reasons such materials are preferred, which are easily processed to cells with conventional technical means, as e.g. plastic films and coated fabrics.

The control system according to the invention for the amount of pressure medium supplied advantageously comprises a fluid throttling cell 45 formed, for example, of deformable films, which has orifices 35, 36, respectively for the supply and removal of the pressure medium and a blocking element acting therebetween, thus, for example, a ridge 11, which compresses the cell 45 between the two orifices and thereby controls the amount of pressure medium to the motor flowing into the outlet orifice. The torque-dependent blocking element, for example the said ridge, moreover advantageously forms part of one section of the housing of the motor.

The control element is preferably in the form of a pinching element 8, 9, 11 and a device for increasing the (resistance) against the opening of the pinching element such as, for example, a spring-loaded insert 20, 21, 23. In particular, the pinching element may comprise a distance adjusting screw 16 for presetting the minimum feed cross-section, as well as an end stop 27 for limiting the maximum feed cross-section. More particularly, the pinching element may be formed as part of the motor housing, for example as an extension or projection of a transversely divided housing 3, 4. The motor housing may advantageously have two hingedly connected halves 3,4. The appropriate maximum and minimum settings for the pinching element for any particular application are by simple trial and error.

It is apparent from the above that, in particular, the fluid cells 30, on the one hand, regulate the (dossage) of the pressure medium directly via the sections of the housing, and, on the other hand, simultaneously control the torque characteristic of the motor by automatically increasing and reducing the aperture angle between the supporting disc and the supporting cone. For the output control method in question, the throttling cell in the pressure medium line is mechanically positioned by the running speed-dependent back pressure in the fluid cells. In this case the possibility to mechanically transmit these pressures by means of the wedge forces in the housing is typical for the invention. It goes without saying that in lieu of the clamping element other constructions may be used which are equivalent for the man skilled in the art. Preferred construction materials for the throttling cells are similar to the ones referred to above for the fluid cells.

The said fluid cells 30 and/or the throttling cell 45 are attached with advantage to one of their bearing surfaces 37 or 8 respectively, for example by cementing them on.

Many modifications in and to the above-described preferred embodiments will occur to those skilled in the art. It is intended to cover all such modifications which fall within the spirit and scope of the claims appended hereto.

What is claimed is:

1. A motor having an output shaft, the motor adapted to be driven by a pressure medium wherein the flow of pressure medium is automatically controlled by the torque requirements of the output shaft comprising first and second housing portions pivotably connected to each other, first and second members rotatably mounted in said first and second housing portions respectively, the axes of said first and second members being offset with respect to one another, inflatable and deflatable fluid cells between said members for rotatably coupling said members together, said output shaft being rotatably mounted in one of said members, pressure medium passage means between said housing portions for supplying pressure medium to said fluid cells, pinching means on one of said housing portions adjacent said passage means for controlling the cross section of said passage means available for the flow of pressure medium, spring means for normally urging said housing portions toward each other, said housing portions being relatively movable apart from each other against said spring means to increase the said flow cross section to permit the greater amount of pressure medium to flow to said fluid cells in response to an increase in torque on said output shaft, and towards each other to decrease the said flow cross section to decrease the flow of pressure medium to said fluid cells in response to a decrease in torque on said output shaft, means for limiting the maxium flow cross section of said passage means, and means for limiting the minimum flow cross section of said passage means.

2. The motor according to claim 1 wherein the axes of the first and second members intersect at an angle, said angle changing in response to movement of the housing portions to increase and decrease the torque applied by the motor to the output shaft.

3. The motor according to claim 1 wherein one of the housing portions is fixed and the other of said housing portions is pivotable with respect to the fixed housing portion.

4. The motor according to claim 1 wherein the means for limiting the minimum flow cross section comprises a screw mounted in one of said housing portions and adapted to contact the other of said housing portions, said screw being rotatable in said one housing portion to vary the minimum distance between said housing portions.

5. The motor according to claim 1 wherein said passage means is a throttling cell having inlet and outlet openings for the pressure medium, said pinching means being located between said inlet and outlet openings.

6. The motor according to claim 5 wherein said throttling cell is mounted in one of said housing portions and the pinching element is mounted on the other of said housing portions.

7. The motor according to claim 1 wherein said means for limiting the maximum flow cross section comprises a yoke on one of said housing portions and a flange on the other of said housing portions, said flange fitting inside said yoke and adapted to contact said yoke to thereby set the maximum movement between said housing portions.

8. The motor according to claim 7 wherein said yoke further comprises a screw adapted to coact with said flange for changing the maximum opening between the housing portions.

* * * * *